US005947614A

United States Patent [19]

Shoji et al.

[11] Patent Number: 5,947,614

[45] Date of Patent: Sep. 7, 1999

[54] PRINTING SYSTEM WITH MECHANISM FOR ATTACHINGLY SUPPORTING RECORDING MEDIUM

[75] Inventors: Yutaka Shoji; Shuichi Morio; Shigenori Suematsu; Hiroshi Takahagi; Masahito Katada, all of Hitachinaka, Japan

[73] Assignee: Hitachi Koki Co., Ltd., Tokyo, Japan

[21] Appl. No.: 09/164,775

[22] Filed: Oct. 1, 1998

[30] Foreign Application Priority Data

Oct. 3, 1997 [JP] Japan ..... 9-271057

[51] Int. Cl.[6] ..... B41J 3/28

[52] U.S. Cl. ..... 400/23

[58] Field of Search ..... 400/23, 29, 44

[56] References Cited

U.S. PATENT DOCUMENTS 2,115,692 4/1938 Thorn ..... 400/23

*Primary Examiner*—Edgar Burr
*Assistant Examiner*—Minh H. Chau
*Attorney, Agent, or Firm*—Whitham, Curtis & Whitham

[57] ABSTRACT

A printing system having a mechanism for fixing a large scale recording medium in a vertical orientation on an electrostatically adsorption plate provided on a base. The fixing mechanism includes a main holding unit provided on the base, a supplementary holding unit detachably fixed on the main holding unit, and a fixing unit for fixing the supplementary holding unit to the main fixing unit. The supplementary holding unit is first detached from the main fixing unit, and is placed on a tabletop. With this posture, a recording medium is fixed to the supplementary holding unit. Then, the supplementary holding unit holding the recording unit is fixed to the main holding unit. In the fixing operation, the fixing unit automatically changes a held fashion of the recording medium from by the supplementary holding unit to by the main holding unit.

14 Claims, 7 Drawing Sheets

PRINTING SYSTEM WITH MECHANISM FOR ATTACHINGLY SUPPORTING RECORDING MEDIUM

BACKGROUND OF THE INVENTION

The present invention relates to a mechanism for attaching a recording medium to a printing system.

Fixing units have been known for fixing a recording medium to a recording device. For example, fixing units have been known for directly attaching a recording medium to a recording device using clinging force of static electricity or air suction. With these type of fixing units, the user manually positions the recording medium near the fixing unit so that the static electric force or suction force can pull the recording medium and fix it in place. However, when the user grasps the recording medium and carries it from where it is stored to the fixing unit, the recording medium can be folded or wrinkled where the user grasps the recording medium. This is particularly a problem when the recording medium is large sized.

There are also known mechanisms that clasp a recording medium from above and support the recording medium in the vertical direction. However, before the user fixes the position of the recording medium using such a mechanism, the user must first align the recording medium in the horizontal direction while supporting it in the vertical direction. These two processes can be tedious to perform simultaneously.

When the recording medium is large, the user must support the recording medium to prevent it from falling while positioning the recording medium horizontally. Therefore, such mechanisms are extremely difficult to use.

Further, it is difficult to support the weight of large recording media having a size of an A2 sheet or larger. This is especially the case when the recording medium is a lithographic plate, such as an aluminum plate, used in a lithographic printing machine. Simple conventional fixing devices can not support such plates.

SUMMARY OF THE INVENTION

It is therefore, an object of the present invention to provide a mechanism capable of fixing a variety of different types of recording mediums in a vertical direction with a correct orientation using simple operations and without regard to size of the recording medium.

This and other objects of the present invention will be attained by providing a printing system for forming a printing image on a recording medium including a print unit, an arm, a base portion, and a recording medium attachment mechanism. The print unit is adapted printing images on the recording medium. The arm portion movably supports the print unit. The base portion is positioned in confrontation with the arm portion. The recording medium is set on the base portion. The recording medium attachment mechanism is adapted for setting the recording medium on the base portion. The mechanism includes a main holding unit, a supplementary holding unit, and fixing means. The main holding unit is fixed to and supported by the base portion in opposition with and separated from the print unit by a predetermined distance. The main holding unit is formed with a mounting portion. The supplementary holding unit is detachably fitted in the mounting portion and includes a holding means for temporarily holding the recording medium. The fixing means is provided between the main holding unit and the supplementary holding unit for releasably fixing the supplementary holding unit to the main holding unit and automatically switches a held condition of the recording medium from being held by the supplementary holding unit to being held by the main holding unit in interlocking relation with mounting the supplementary holding unit in the mounting portion and fixing the supplementary holding unit to the main holding unit by the fixing means.

For setting the image recording medium to the printing system, the first the supplementary holding unit is detached from the main holding unit. Then a recording medium is fixed to the supplementary holding unit while the supplementary holding unit is in a detached condition from the main holding nit. For example, the supplementary holding unit could be laced stably on a table top so the user's efforts could be limited to moving and aligning the recording medium. After the recording medium is fixed to the supplementary holding unit, the supplementary holding unit is reattached to the main holding unit. With this configuration, the user does not directly touch the recording medium when attaching the supplementary holding unit to the main holding unit so there is no danger of the user folding or wrinkling the recording medium.

When the supplementary holding unit is attached to the main holding unit, the fixing means automatically changes a held fashion of the recording medium from by the supplementary holding unit to by the main holding unit in interlocking relation with mounting the supplementary holding unit in the mounting portion and fixing the supplementary holding unit to the main holding unit by the fixing means. Therefore, the recording medium can be reliably and easily fixed in place, regardless of whether the supplementary holding unit is attached in close intimate contact with or somewhat loosely to the main holding unit. Further, the recording medium can be reliably and easily fixed in place even when contacting surfaces, such as a nipping surface of the supplementary holding unit or the main holding unit are not perfectly even and flat.

BRIEF DESCRIPTION OF THE DRAWINGS

In the drawings:

FIG. 2(*b*) is an exploded view showing the supplementary holding unit of FIG. 2 (*a*);

FIG. 3 (*b*) is a cross-sectional view showing the supplementary holding unit of FIG. 2 (*a*) in a recording medium release condition;

FIG. 4(*b*) is a view for description of force-balancing state between a hook and a shaft in the supplementary holding unit;

FIG. 4(*c*) is a view showing a modification of the hook;

FIG. 6 (*b*) is a cross-sectional view showing the supplementary holding unit after having been attached to the main holding unit; and, FIG. 7 is a cross-sectional view showing a modified supplementary holding unit having a pin to improve supporting strength and accuracy of alignment for the recording medium.

DETAILED DESCRIPTION OF THE PREFERRED EMBODIMENTS

Figure 1:
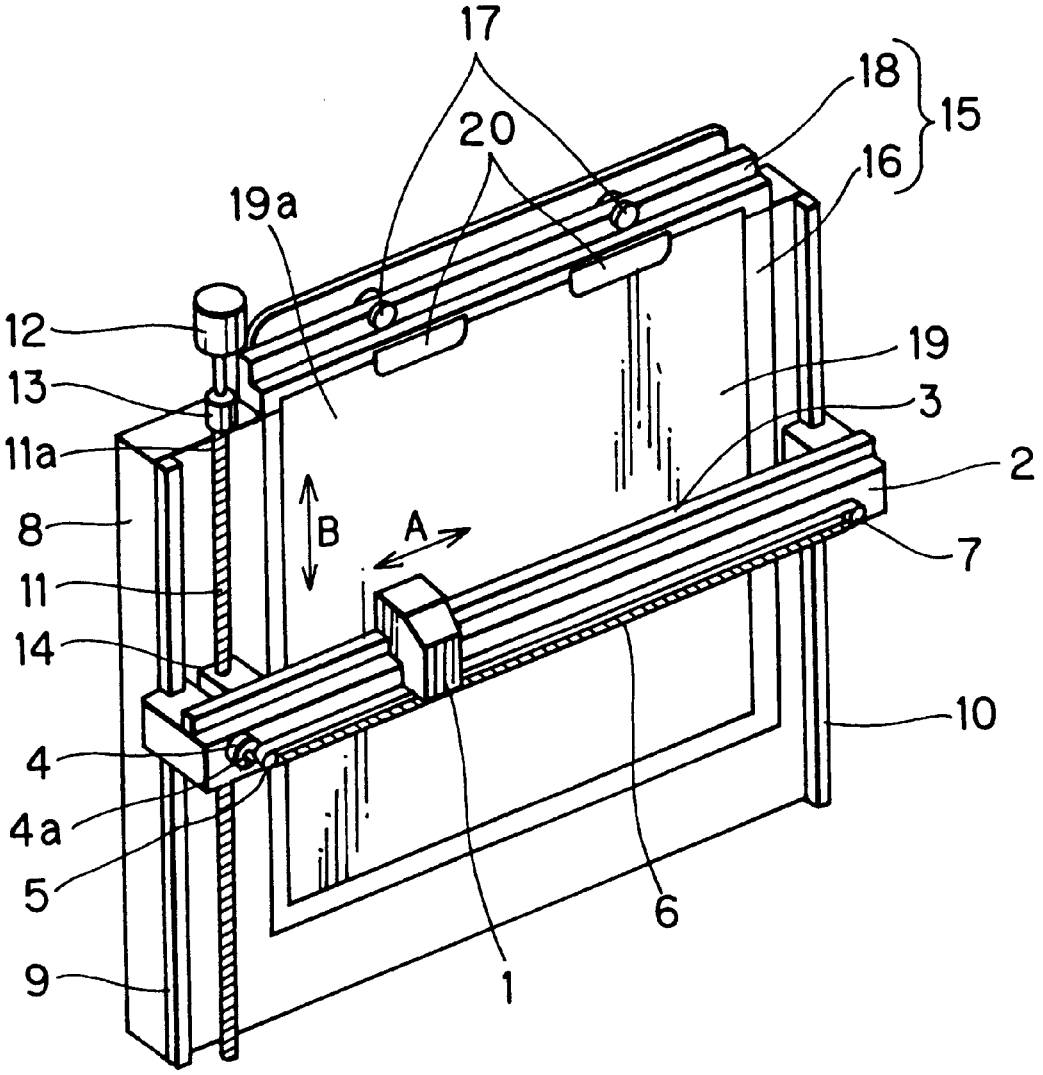
FIG. 1 is a perspective view showing an overall configuration of a printing system including a recording medium attachment mechanism according to an embodiment of the present invention.

A printing system according to a preferred embodiment of the present invention will be described while referring to the accompanying drawings wherein like parts and components are designated by the same reference numerals to avoid duplicating description.

As shown in FIG. 1, the printing system includes a recording head portion 1, a base 8, a recording medium attachment mechanism 15, and a print head transport mechanism. The recording head portion 1 includes an ink jet type print head. The head transport mechanism includes a first linear movement mechanism for transporting the recording portion 1 in horizontal direction A, and a second linear movement mechanism for transporting the recording portion in a vertical direction B.

The first linear movement mechanism includes an arm portion 2, a guide rail 3, a motor 4, a drive pulley 5, a follower pulley 7, and a timing belt 6. The arm portion 2 extends in the horizontal direction for supporting the recording portion 1. The guide rail 3 extends in parallel with the arm portion 2 for guiding reciprocal movement of the recording portion 1. The motor 4 is mounted on the arm portion 2 and the drive pulley 5 is fixed to a rotational shaft 4*a* of the motor 4. The follower pulley 7 is rotatably supported on the arm portion 2, and the timing belt 6 is mounted on the drive pulley 5 and the follower pulley 7. A portion of the recording portion 1 is engaged with the timing belt 6. Therefore, forward and reverse rotation of the motor 4 reciprocally moves the printing portion 1 in the directions indicated by arrows A.

The second linear movement mechanism includes a pair of Guide rails 9, 10, a ball screw 11, a motor 12, a coupling 13, and a block 14. The guide rails 9, 10 are fixed to the base 8 at opposite edges thereof and extend in a vertical direction of the base 8 for guiding vertical travel of the arm portion 2. The ball screw 11 also extends in the vertical direction and is rotatable about its axis. The coupling 13 is provided at an upper end 11*a* of the ball screw 11 for connecting the motor 12 to the ball screw 11. The block 14 is fixed to the arm portion 2, and the ball screw 11 is threadingly engaged with the block 14. With this configuration, the block 14 moves up and down upon rotation of the ball screw 11 in association with forward and reverse rotation of the motor 12. Accordingly, the arm portion 2 can be moved in the directions indicated by arrows B.

The recording medium attachment mechanism 15 is supported in confrontation with the print portion 1 separated by a fixed distance. The recording medium attachment mechanism 15 includes a main holding unit 16 fixed to the base portion 8 by screws, for example, and a supplementary holding unit 18, which is detachably attached to the main holding unit 16 by two bolts 17.

Figure 6A:
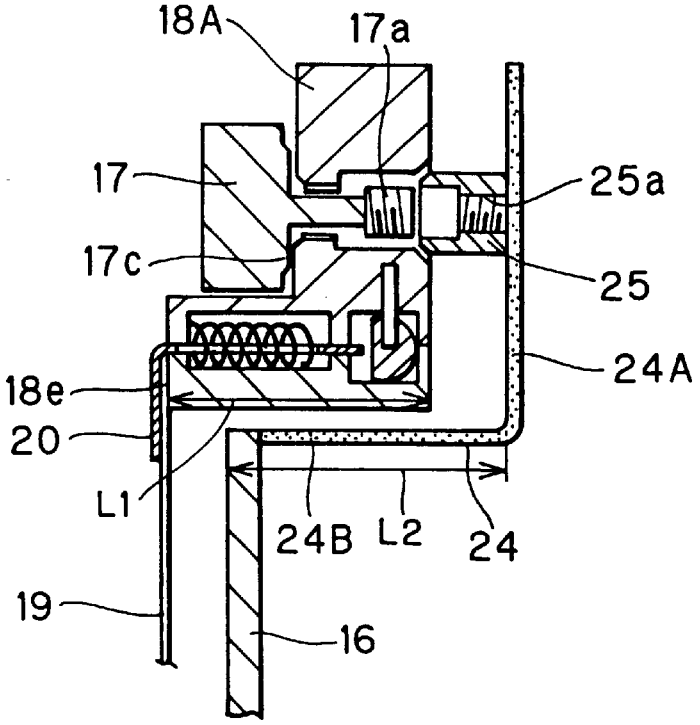
FIG. 6 (*a*) is a cross-sectional view showing the supplementary holding unit in the process of being attached to the main holding unit.
Figure 6B:
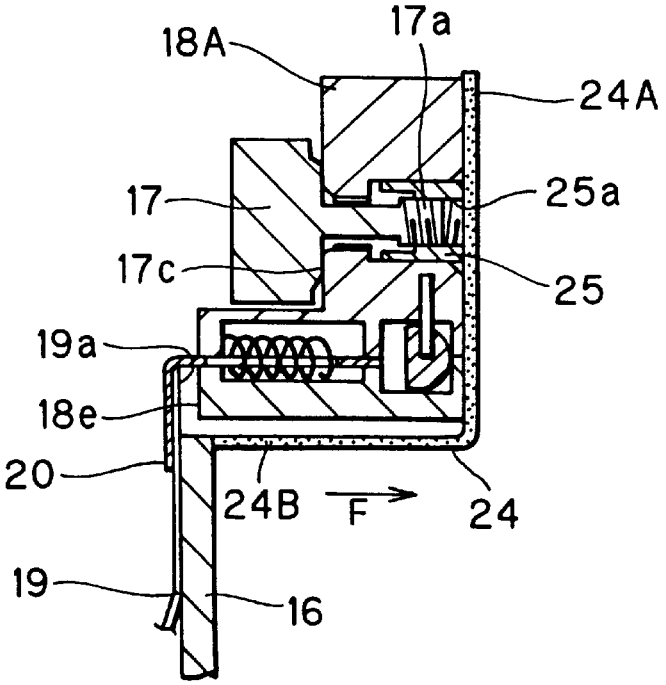

The supplementary holding unit 18 includes two hooks 20 for attaching a recording medium 19, such as paper or plastic film. In a manner to be described later, the two hooks 20 are constantly urged toward the main holding unit 16 so that an upper edge 19*a* of the recording medium 19 is fixedly sandwiched between the hooks 20 and the main holding unit 16 as best shown in FIG. 6(*b*).

The main holding unit 16 is formed from an electrostatic adsorption plate that generates static electricity when a power source is turned on. Such electrostatic adsorption plates are well known in the art so detailed description will be omitted here. With this configuration, the recording medium attachment mechanism 15 mechanically fixes the upper edge 19*a* of the recording medium 19 to the main holding unit 16 by the hooks 20 and electrostatically adsorbs other portions of the recording medium 19, that is, other than the upper edge 19*a,* to the main holding unit 16.

When the recording medium 19 is fixed to the recording medium attachment mechanism 15, which is configured by the main holding unit 16 and the supplementary holding unit 18, characters, symbols, and the like can be printed on the recording medium 19 by moving the print portion 1 vertically and horizontally in the directions indicated by arrows A and B with respect to the recording medium 19 and ejecting ink from the print portion 1 while it moves.

Figure 2A:
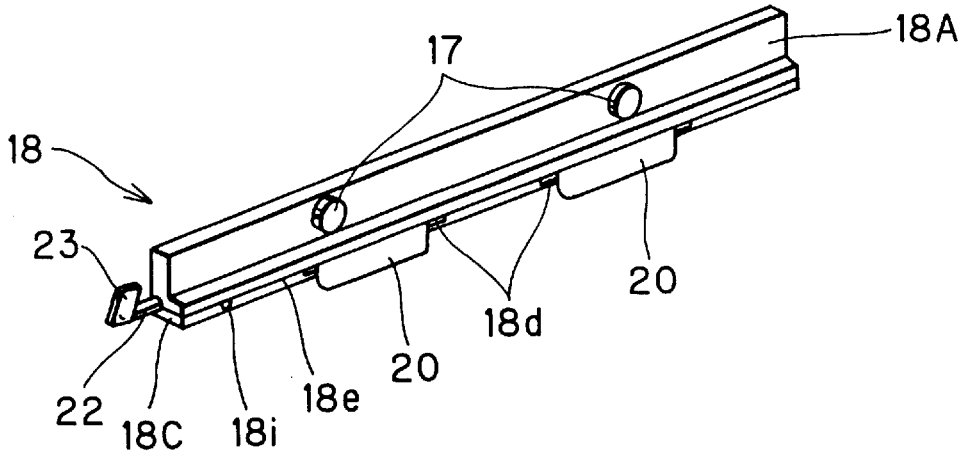
FIG. 2(*a*) is a perspective view showing an supplementary holding unit of the recording medium attachment mechanism of the printing system shown in FIG. 1.
Figure 2B:
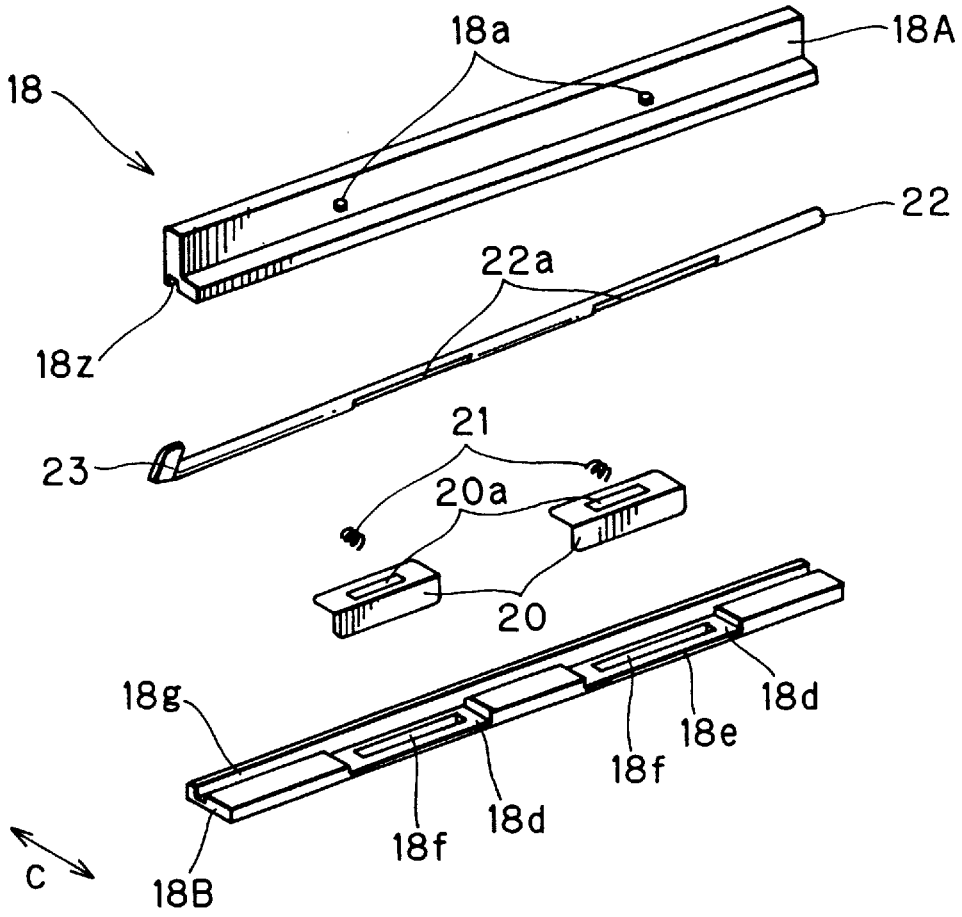

Next, the supplementary holding unit 18 will be described while referring to FIGS. 2(*a*) through 3(*b*).

Figure 3A:
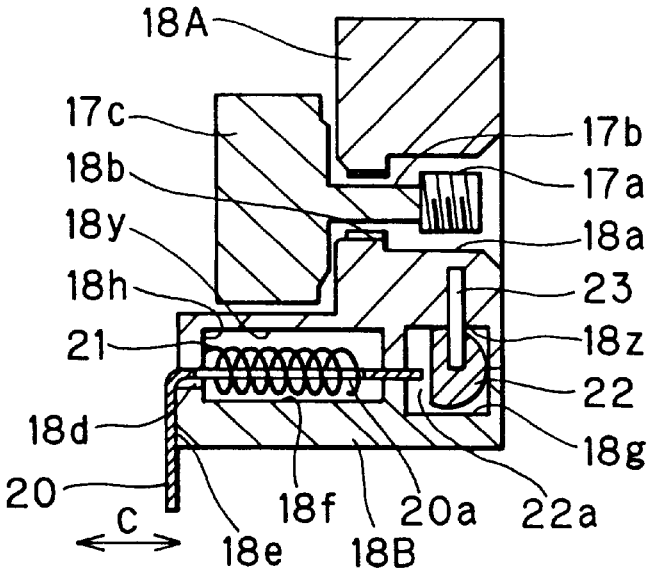
FIG. 3 (*a*) is a cross-sectional view showing the supplementary holding unit of FIG. 2 (*a*) in a recording medium attachment condition.
Figure 3B:
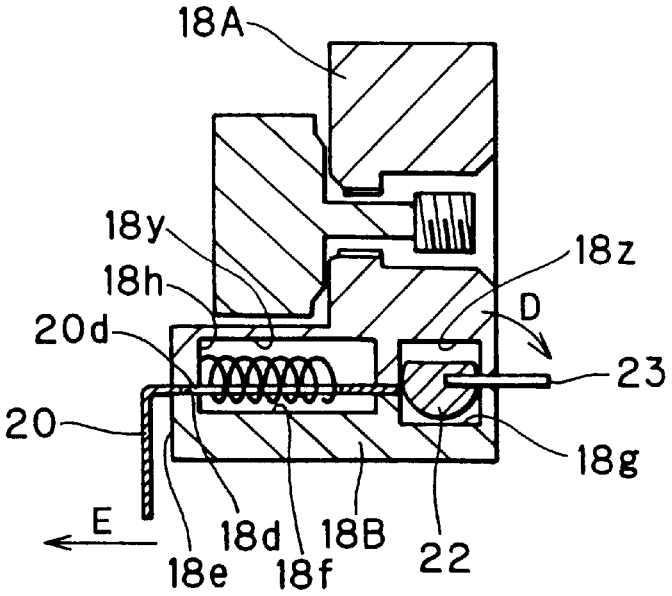

The supplementary holding unit 18 includes an upper cover 18A, a lower cover 18B, a shaft 22 disposed between the upper and lower covers 18A and 18B, and the hooks 20. As shown in FIG. 2(*b*), two guide holes 18*a* are formed in the upper cover 18A. As shown in FIGS. 2(*a*) and 3(*a*), a bolt 17 is unreleasably supported in each of the guide holes 18*a*. As shown in FIGS. 3(*a*) and 3(*b*), a female screw 18*b* is formed at an inner surface and one side of each of the guide holes 18*a*. The female screw 18*b* has an inner diameter smaller than that of the guide holes 18*a*. Also, each bolt 17 includes a bolt head 17*c,* a shaft portion 17*b* with a diameter smaller than an inner diameter of the female screw 18*b,* and a male screw 17*a* for engaging with the female screw 18*b*. With this configuration, the bolts 17 are freely movable in their axial directions in the guide holes 18*a* of the supplementary holding unit 18. However, the bolts 17 will not fall out of the guide holes 18*a* unless the male screws 17*a* are completely screwed out of the female screws 18*b*. As shown in FIGS. 3(*a*) and 3(*b*), the upper cover 18A is formed at its lower surface with cut-out portions 18*y* and a groove 18*z*. The upper cover 18A has a front surface at which a mark 18*i* is formed which indicates a left edge position of the image recording medium 19 when it is held by the supplementary holding unit 18.

The lower cover 18B is fixed to the upper cover 18A by a screw (not shown). The surface of the lower cover 18B in confrontation with the upper cover 18A*a* is formed with indented portions 18*d,* cut-out portions 18*f,* and a groove 18*g*. The cut-out portions 18*f* and the groove 18*g* are formed at positions corresponding to positions of the cut-out portions 18*y* and the groove 18*z,* respectively, of the upper cover 18A. Each cut-out portion 18*f* is formed in each indented portion 18*d*. The lower cover 18B has a front surface 18*e* serving as a nipping surface for temporarily nipping the upper end 19*a* of the image recording medium 19 between the nipping surface 18*e* and the hook 20.

As shown in FIG. 3 (*a*), each hook 20 is supported in each indented portion 18*d* so as to be slidable in the directions indicated by arrows C. Each hook 20 has a substantial L-shape in cross-section, with a horizontally oriented portion and a downward extending portion. The horizontally oriented portion is formed with a slot 20*a* in which a compression spring 21 can be set. The downward extending portion protrudes beyond the lower surface of the lower cover 18B. The compression coil spring 21 is adapted for urging the corresponding hook 20 toward the nipping surface 18*e* of the lower cover 18B. The compression coil spring 21 is housed independently for each of the two hooks in each cut-out portion 18*f*.

One end of each spring 21 is seated on a front wall 18*h* of the corresponding cut-out portion 18*f* and the other end of each coil spring 21 is engaged on the rear surface of the slot 20*a* of the corresponding hook 20. With this arrangement, the compression coil spring 21 urges the hook 20 rearwardly, so that the downwardly extending portion of the hook 20 is urged toward the nipping surface 18*e*.

The shaft 22 has a circular cross-section. However, as shown in FIG. 2(*b*), the shaft 22 is formed with cut surfaces 22*a* at portions thereof that confront the hooks 20. As a result, the shaft 22 has generally a semicircular appearance in cross-section at the cut surfaces 2*a* as shown in FIGS. 3(*a*) and 3(*b*). A lever 23 is attached, for example, by a screw, to one end of the shaft 22 for rotating the shaft 22 about its axis X. The shaft 22 is supported in the grooves 18*z*, 18*g* so as to be rotatable between the posture shown in FIG. 3(*a*) to the posture shown in FIG. 3(*b*) by the manipulation of the lever 23.

At the cut surface 22*a*, the shaft 22 has a configuration greater than the semi-circle. More specifically, as shown in FIG. 4(*a*), the shaft at the cut surfaces 22*a* includes the half circle g1 on one side of a rotational shaft x and another portion g2 on the other side of the rotational shaft x.

When the lever 23 is oriented vertically as shown in FIG. 3(*a*), the cut surfaces 22*a* of the shaft 22 are in opposition with the hooks 20, so that a space is opened up between the shaft 22 and the hooks 20. When the hooks 20 and the cut surfaces 22*a* of the shaft 22 are separated by a space, the urging force of the coil springs 21 is free to draw the hooks 20 to the right in FIG. 3(*a*) to stably press the hooks 20 against the nipping surface 18*e* of the lower cover 18B of the supplementary holding unit 18. Therefore, the upper end 19*a* of the image recording medium 19 can be temporarily nipped between the hook 20 and the nipping surface 18*e*.

FIG. 3(*b*) shows the lever 23 of the shaft 22 rotated from the vertical orientation shown in FIG. 3(*a*) by 90° in the direction indicated by the arrow D of FIG. 3(*b*). In this orientation, a curved portion of the shaft 22 is in confrontation with the hooks 20 so that the hooks 20 are pressed out in the direction indicated by arrow E of FIG. 3(*b*) against the biasing force of the compression coil spring 21. Accordingly, the hooks 20 can be separated from the nipping surface 18*e* of the supplementary holding unit 18 so that the recording medium 19 can be inserted between the hook 20 and the nipping surface 18*e*.

Figure 4A:
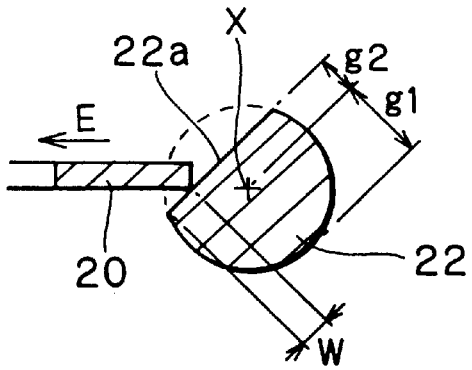
FIG. 4(*a*) is a view for description of positional relationship between the hook and the shaft.
Figure 4B:
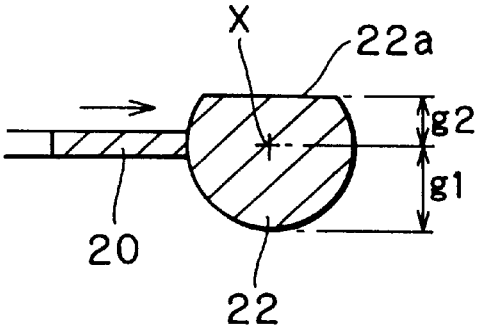
Figure 4C:
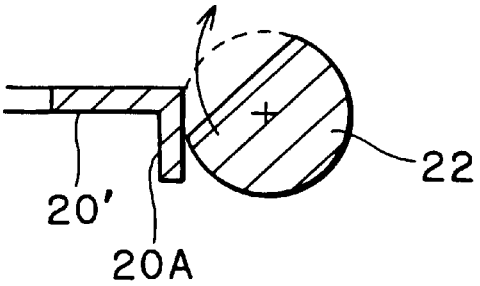

It should be noted that as shown in FIG. 4 (*a*) the cut surfaces 22*a* of the shaft 22 will abut against the end of corresponding hooks 20 by a width W when the lever 23 of the shaft 22 is rotated from the vertical orientation shown in FIG. 3(*a*) to the orientation shown in FIG. 3(*b*). However, because the cross-section of the shaft 22 at the cut surfaces 22*a* is larger that a half circle, the width w is not sufficiently wide to block rotation of the shaft 22. Therefore, the user can rotate shaft 22 into the orientation shown in FIG. 3(*b*) by applying slight force to the lever 23.

Further, as shown in FIG. 4(*b*), when the lever 23 is pivotally moved to its horizontal posture, the end of the hook 20 is in alignment with the lever 23 passing through the rotational center x of the shaft 22. Therefore, the hook 20 can be positioned stably at a position to assure separating position of the hook 20 with respect to the nipping surface 18*e*.

Incidentally, FIG. 4(*c*) shows a modification to the hook. The hook 20' has a rear downwardly bent end portion 20A which facilitates rotation of the shaft 22 in the clockwise direction in FIG. 4(*c*).

Figure 5:
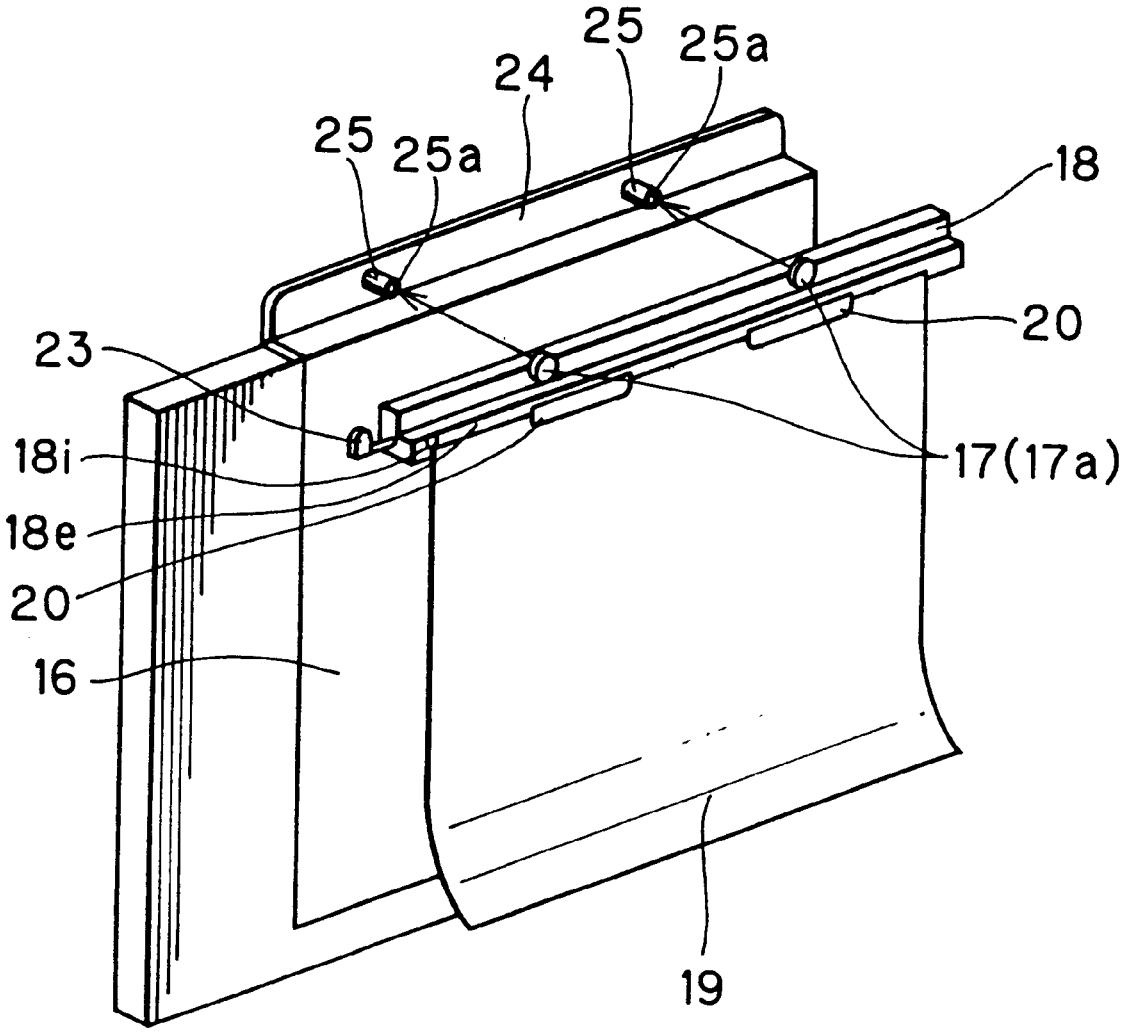
FIG. 5 is an exploded view showing attachment of the supplementary holding unit to a main holding unit of the recording medium attachment mechanism according to the embodiment.

As shown in FIG. 5, the main holding unit 16 has an upper end portion fixed with, by screws (not shown), a guide plate 24 having a vertical wall portion 24A and a horizontal wall portion 24B. Further, a pair of guide pins 25 are fixed to the vertical wall portion 24A by screws (not shown). As shown in FIG. 6(*a*), a female screw 25*a* is formed in the interior of each of the guide pins 25. The female screw 25*a* is threadingly engageable with the male screw 17*a* of the bolt 17. As also shown in FIG. 6(*a*), the supplementary holding unit 18 is formed with a front-to-rear length L1 that is shorter than a front-to-rear length L2 of the horizontal portion 24B.

Next, an explanation will be provided for fixing the recording medium to the printing system. First, the recording medium 19 is fixed between the nipping surface 18*e* of the supplementary holding unit 18 and the hooks 20. To this effect, the supplementary holding unit 18 is detached from the main holding unit 16. Then, the lever 23 is rotated so that the hooks 20 protrude in the direction E from the supplementary holding unit 18 as shown in FIG. 3(*b*). The recording medium 19 is then inserted between the hooks 20 and the nipping surface 18*e*.

When aligning the recording medium 19, the recording medium 19 is positioned with respect to the supplementary holding unit 18 in the vertical direction by abutment between the two hooks 20 and the upper edge of the recording medium 19 and in the horizontal direction by aligning the left edge of the recording medium 19 with the mark 18*i* of the supplementary holding unit 18. The recording medium 10 can be easily aligned in the supplementary holding unit 18 when alignment is performed on a table top. That is, because the supplementary holding unit 18 is placed on a table top, the recording medium 19 is also supported by the table top, so that the recording medium 19 can be easily aligned relative to the supplementary holding unit 18.

After the recording medium 19 has been properly positioned, the lever 23 is rotated so that the hooks 20 retract back toward the supplementary holding unit 18 as shown in FIG. 3(*a*), thereby firmly fixing the recording medium 19 by pressing force of the hook 20 against the nipping surface 18*e* of the supplementary holding unit 18 by the biasing force of the compression coil spring 21.

Next, the operation of attaching the supplementary holding unit 18 to the main holding unit 16 will be explained while referring to FIGS. 5 through 6(*b*). After the recording medium 19 is fixed onto the supplementary holding unit 18, the user moves the supplementary holding unit 18 into confrontation with the main holding unit 16 as shown in FIG. 5. The user can easily carry the supplementary holding unit 18 to this position, and also easily perform operations for attaching the supplementary holding unit 18 onto the main holding unit 16, by holding one of the two bolts 17 in each hand.

The user then aligns the male screws 17*a* of the bolts 17 with the guide pins 25 of the guide plate 24 as shown in FIG. 6 (*a*). FIG. 6 (*a*) shows the supplementary holding unit 18 directly before it is mounted onto the main holding unit 16, that is, before the male screws 17*a* of the bolts 17 are screwed into the guide pins 25 of the guide plate 24. At this time, the recording medium 19 is fixed in place by pressing force of the hooks 20 against the nipping surface 18*e* of the supplementary holding unit 18.

FIG. 6 (*b*) shows the supplementary holding unit 18 after having been mounted onto the main holding unit 16, that is after the male screws 17*a* have been screwed into the female screws 25*a* of the guide pins 25. At this time, the hooks 20 are separated from the nipping surface 18*e* of the supplementary holding unit 18. However, the recording medium 19 is fixed in place by pressing force of hooks 20 against the main holding unit 16.

That is, when the male screws 17*a* of the bolts 17 are screwed gradually into corresponding female screws 25*a* of the guide pins 25 from the condition shown in FIG. 6 (*a*), a rear surface 17*c* of the bolts 17 abuts against the supplementary holding unit 18. Further rotation of the male screws 17*a* moves the entire supplementary holding unit 18 in the direction indicated by arrow F. Because the supplementary holding unit 18 is formed with a front-to-rear length L1 that is shorter than a front-to-rear length L2 of the horizontal portion 24B, and because the each hook 20 has a downward extending portion that protrudes beyond the lower surface of the lower cover 18B, the hooks 20 will catch on the main holding unit 16. From this point, the recording medium 19 is fixed between the hooks 20 and the main holding unit 16.

Further rotation of the male screws 17*a* moves the nipping surface 18*e* further in the direction indicated by the arrow F, but the hooks 20 remain stationary so that a space opens between the hooks 20 and the nipping surface 18*e*. In other words, the hooks 20 move in a direction relative to the nipping surface 18*e* that releases the recording medium 19 from between the hooks 20 and the nipping surface 18*e*.

In other words, when the supplementary holding unit 18, to which a recording medium 19 is already fixed in place, is attached to the main holding unit 16, the nipping surface 18*e* of the supplementary holding unit 18 retracts away from the hooks 20 so that the recording medium 19 is pressingly fixed between the hooks 20 of the supplementary holding unit 18 and the main holding unit 16. In this way, the recording medium 19 can be easily and reliably fixed to the main holding unit 16 even if the bolts 17 are screwed in by differing amounts, for example, by being screwed on by each being turned a different number of times, or even if the nipping surface 18*e* of the supplementary holding unit 18 or the surface of the main holding unit 16 that abuts against the hooks 20 is uneven.

After the supplementary holding unit 18 has been attached to the main holding unit 16 as shown in FIG. 6(*b*), when the bolts 17 are later loosened from the guide pins 25 to detach the supplementary holding unit 18 from the main holding unit 16, the hooks 20 will separate from the main holding unit 16, thereby releasing the recording member 19 from between the hooks 20 and the main holding unit 16. However, at this time, the recording medium 19 will be fixed between the supplementary holding unit 18 and the hooks 20 as shown in FIG. 6(*a*), so that the supplementary holding unit 18, and consequently the recording medium 19, can be detached from the printing system without falling.

Figure 7:
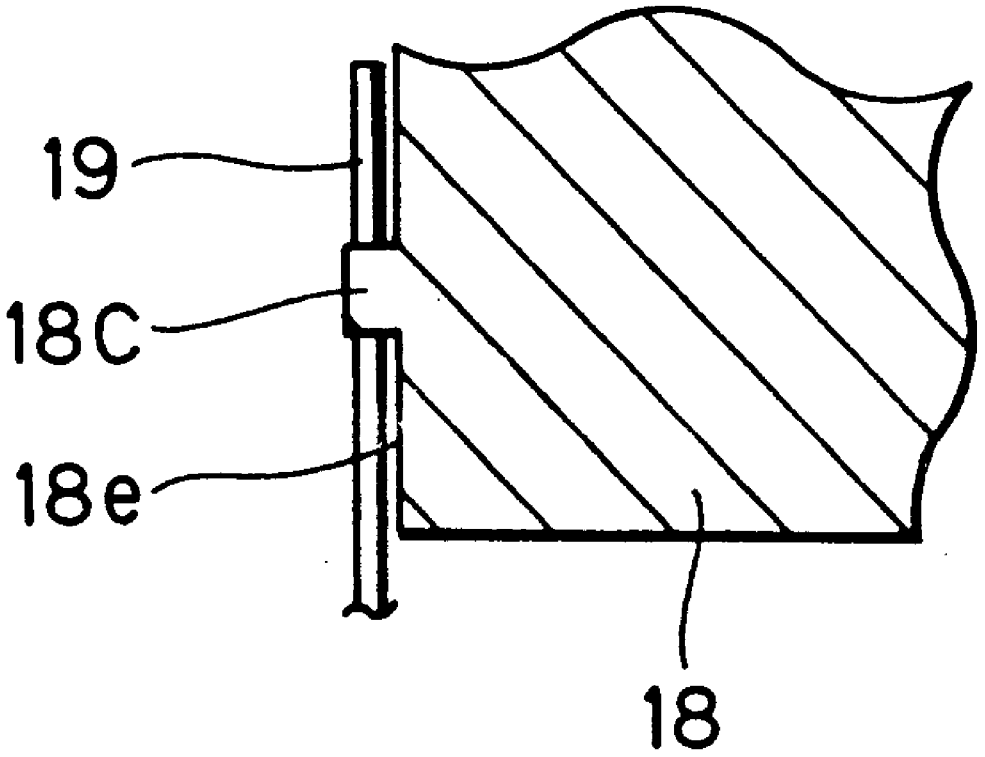

In the embodiment, the user positions the recording medium 19 on the supplementary holding unit 18 in the vertical direction by abutting the recording medium 19 against the two hooks 20 and in the horizontal direction by aligning the edge of the recording medium 19 with the mark 18*i* of the supplementary holding unit 18. However, the recording medium 19 can be formed with a plurality of holes and the supplementary holding unit 18 can be provided with positioning pins that engage in the holes. FIG. 7 shows a positioning pin 18C engaged in a hole formed in the recording medium 19. With this arrangement, positioning of the recording medium to the supplementary holding unit 18 can be accurately performed. Further, because of the engagement between the pins and holes, the image recording medium can be stably fixed to the supplementary holding unit 18.

Further, a special supplementary holding unit 18 can be provided separately for each of a variety of different recording media having different shapes and thicknesses and formed from different materials. When a mechanism is provided for transporting a recording medium such as a roll sheet, the supplementary holding unit 18 might interfere with transport of the recording medium. In this case, the supplementary holding unit 18 can be removed.

A mechanism according to the present invention is not limited to use for attaching paper recording media, but could instead be used to attach plate materials, such as aluminum plate, used in a lithographic printing machine. Also, the mechanism according to the present invention can be used for attaching large recording media, such as a A2 size or larger sheets. Large paper sheets or aluminum plates, which are heavier than ordinary paper sheets, can be reliably attached using the present invention without worrying about weight of the recording medium. In particular, because recording media can be fixed in a planar condition using the fixing mechanism of the present invention, printing can be performed using stiff and difficult to bend recording media, such as plate materials, such as aluminum plate.

While the invention has been described in detail with reference to specific embodiments thereof, it would be apparent to those skilled in the art that various changes and modifications may be made therein without departing from the spirit and scope of the invention.

What is claimed is:

1. A printing system for forming a printing image on a recording medium comprising:

a print unit for printing images on the recording medium;

an arm portion movably supporting the print unit;

a base portion positioned in confrontation with the arm portion, the recording medium being set on the base portion; and a recording medium attachment mechanism for setting the recording medium on the base portion, the mechanism including:

a main holding unit fixed to and supported by the base portion in opposition with and separated from the print unit by a predetermined distance, the main holding unit being formed with a mounting portion;

a supplementary holding unit detachably fitted in the mounting portion and comprising a holding means for temporarily holding the recording medium; and, fixing means provided between the main holding unit and the supplementary holding unit for releasably fixing the supplementary holding unit to the main holding unit and automatically switching a held condition of the recording medium from being held by the supplementary holding unit to being held by the main holding unit in interlocking relation with mounting the supplementary holding unit in the mounting portion and fixing the supplementary holding unit to the main holding unit by the fixing means.

2. The printing system as claimed in claim 1, wherein the arm portion is provided with a first movement means for moving the print unit in a first direction;

and wherein the base portion is provided with a second movement means for moving the arm portion in a second direction perpendicular to the first direction.

3. The printing system as claimed in claim 2, wherein the base portion extends in a vertical direction and has an upper portion, the first direction being a horizontal direction, and the second direction being the vertical direction, the main holding portion being positioned at the upper portion of the base portion.

4. The printing system as claimed in claim 3, wherein the holding means of the supplementary holding unit comprises:

a nipping surface portion on which the recording medium is to be placed; and a hook member for temporarily nipping the recording medium between the nipping surface portion and the hook member; the fixing means changing nipping manner from between the hook member and the nipping surface portion to between the hook member and the base portion when the supplementary holding unit is mounted in the mounting portion and is fixed to the main holding unit by the fixing means.

5. The printing system as claimed in claim 4, wherein the supplementary holding unit further comprises a selection means movable between a first position for moving the hook member toward the nipping surface portion for nipping the recording medium therebetween and a second position for moving the hook member away from the nipping surface portion for releasing the recording medium.

6. The printing system as claimed in claim 4, wherein the nipping surface portion is provided with a positioning pin, and wherein the recording medium has an upper portion formed with a positioning hole engageable with the positioning pin.

7. The printing system as claimed in claim 5, wherein the supplementary holding unit further comprises a cover member having one end surface defining the nipping surface portion, the hook member being slidably disposed in the cover member in a direction toward and away from the nipping surface portion;

and wherein the hook member provides an L-shaped configuration having a horizontal section slidable in the cover and abuttable on the selection means and a downwardly extending section provided outside of the cover member and movable toward and away from the nipping surface portion, the downwardly extending section having a lower portion faceable with the base portion.

8. The printing system as claimed in claim 7, wherein the main holding unit comprises:

a guide plate having a vertical wall section and a horizontal wall section serving as the mounting portion, the horizontal wall section having a length greater than a length of the cover member; and an electrostatical adsorption plate provided on the base for electrostatically adsorbing the recording medium.

9. The printing system as claimed in claim 8, wherein the selection means comprises:

a biasing member provided in the cover member for normally urging the downwardly extending section of the hook member toward the nipping surface portion; and a cam member engageable with the horizontal section of the hook member for moving the downwardly extending section of the hook member away from the nipping surface portion against a biasing force of the biasing member.

10. The printing system as claimed in claim 9, wherein the hook member further comprises a bent end portion provided at an end of the horizontal section opposite to the downwardly extending section for engagement with the cam member.

11. The printing system as claimed in claim 9, wherein the fixing means comprises;

a guide pin protruding from the vertical wall section of the main holding unit in a moving direction of the hook member; and a positioning member provided in the supplementary holding unit and engageable with the guide pin, a complete engagement between the guide pin and the positioning member automatically providing the nipping manner of the recording medium between the downwardly extending section of the hook member and the electrostatical adsorption plate.

12. The printing system as claimed in claim 11, wherein the guide pin is formed with a female thread;

and wherein the positioning member comprises a male thread threadingly engageable with the female thread.

13. The printing system as claimed in claim 1, wherein the recording medium comprises an aluminum plate.

14. The printing system as claimed in claim 1, wherein the recording medium has a size equal to or greater than an A2 sheet.

* * * * *